US010370011B2

(12) United States Patent
Drexler et al.

(10) Patent No.: US 10,370,011 B2
(45) Date of Patent: Aug. 6, 2019

(54) LIFTING SYSTEM FOR RERAILING A RAIL VEHICLE

(71) Applicant: SIEMENS AKTIENGESELLSCHAFT, Munich (DE)

(72) Inventors: Stephan Drexler, Sauerlach (DE); Manuel Kroiss, Ebersbach (DE); Antje Opitz, Dachau (DE)

(73) Assignee: Siemens Mobility GmbH, Munich (DE)

( * ) Notice: Subject to any disclaimer, the term of this patent is extended or adjusted under 35 U.S.C. 154(b) by 414 days.

(21) Appl. No.: 15/036,825

(22) PCT Filed: Nov. 6, 2014

(86) PCT No.: PCT/EP2014/073885
§ 371 (c)(1),
(2) Date: May 16, 2016

(87) PCT Pub. No.: WO2015/071159
PCT Pub. Date: May 21, 2015

(65) Prior Publication Data

US 2016/0272227 A1 Sep. 22, 2016

(30) Foreign Application Priority Data

Nov. 15, 2013 (DE) ..... 10 2013 223 382

(51) Int. Cl.
*B61K 5/04* (2006.01)
*B61K 5/02* (2006.01)
(Continued)

(52) U.S. Cl.
CPC ..... *B61K 5/02* (2013.01); *B61G 7/12* (2013.01); *B61G 9/22* (2013.01); *B61K 5/04* (2013.01)

(58) Field of Classification Search
CPC ... B61K 5/00; B61K 5/02; B61K 5/04; B61G 7/04; B61G 7/10; B61G 7/14; B61G 7/12;
(Continued)

(56) References Cited

U.S. PATENT DOCUMENTS 1,755,138 A * 4/1930 Stokes ..... B66C 7/00 105/3
3,228,355 A * 1/1966 Black ..... B61D 3/187 105/458
(Continued)

FOREIGN PATENT DOCUMENTS

DE 1779864 U * 12/1958 ..... B61K 5/00
DE 1779864 U 12/1958
(Continued)

*Primary Examiner* — S. Joseph Morano
*Assistant Examiner* — Scott A Browne
(74) *Attorney, Agent, or Firm* — Laurence Greenberg; Werner Stemer; Ralph Locher

(57) ABSTRACT

A lifting system for rerailing a rail vehicle is particularly suited for rerailing a locomotive. The lifting system has a support profile of an undercarriage structure of the rail vehicle as a lifting point for a rerailing device, the profile support running transversely to the longitudinal axis of the vehicle on a front end of the rail vehicle. It further has a gripping element, which can be lifted and lowered by the lifting device, including two hook-shaped gripping brackets, the hooked profile thereof corresponding to the support profile. The gripping brackets for lifting and lowering the rail vehicle by gripping under the support profile can thereby be symmetrically engaged at the vehicle longitudinal center plane. By this means, a lifting system for rerailing a rail vehicle is provided, in which a frontal lifting device positionable in front of the rail vehicle can be used.

8 Claims, 3 Drawing Sheets

(51) Int. Cl.
*B61G 7/12* (2006.01)
*B61G 9/22* (2006.01)

(58) Field of Classification Search
CPC .... B61G 9/22; B61G 9/24; B61G 9/20; B66C 1/18
See application file for complete search history.

(56) References Cited

U.S. PATENT DOCUMENTS

| | | | | | |
|---|---|---|---|---|---|
| 4,067,471 | A * | 1/1978 | Roatcap | B62D 49/02 | 172/439 |
| 4,556,200 | A * | 12/1985 | Shoemaker | B61K 5/00 | 254/424 |
| 6,581,995 | B1 * | 6/2003 | Zaayman | B66C 1/12 | 294/68.3 |
| 6,607,345 | B2 * | 8/2003 | McElhany | B60P 1/4407 | 414/462 |
| 7,264,130 | B2 * | 9/2007 | Sommerfeld | B61G 9/10 | 213/31 |
| 7,690,314 | B2 * | 4/2010 | Clark | B61D 15/06 | 105/392.5 |
| 2016/0214629 | A1 * | 7/2016 | Drexler | B61G 11/16 | |

FOREIGN PATENT DOCUMENTS

| | | | | |
|---|---|---|---|---|
| DE | 1987744 | U | 6/1968 | |
| DE | 20007595 | U1 | 8/2000 | |
| DE | 19945109 | C1 | 5/2001 | |
| DE | 202010009292 | U1 | 10/2010 | |
| FR | 2698840 | A1 * | 6/1994 | B61D 15/06 |
| RU | 2201366 | C2 | 3/2003 | |
| SU | 255974 | | 11/1969 | |

* cited by examiner

LIFTING SYSTEM FOR RERAILING A RAIL VEHICLE

BACKGROUND OF THE INVENTION

Field of the Invention

The invention relates to a lifting system for rerailing a rail vehicle, in particular a locomotive.

To rerail a rail vehicle lifting brackets are known from utility model publication DE 20 2010 009 292 U1, which can be attached laterally to longitudinal supports of the vehicle body of the rail vehicle. The lifting brackets each have a claw section which grips under the longitudinal support. To lift the rail vehicle the lifting device employed is either a hoisting crane, the support cable of which is connected via a loop to a lifting bolt of the lifting bracket, or else a rerailing bridge, the lifting force of which is induced via a lifting plate of the lifting bracket.

The lifting device is in this case arranged laterally to the rail vehicle and is supported next to the track on the subsoil. When space is restricted in this track region, in particular in a tunnel, this solution cannot therefore be employed. Instead in such situations a crane truck is employed, and is driven in front of the vehicle end of the rail vehicle on which the derailed undercarriage of the rail vehicle is disposed. In the case of rail vehicles with a central buffer coupling the support cable of the crane truck is then laid around the coupling shaft of the central buffer coupling, in order to lift the rail vehicle and to rerail the derailed undercarriage. A disadvantage of this method is that the coupling shaft can only be used as a suspension point for the support cable up to a certain shaft length, since above this shaft length the central buffer coupling itself or its mechanical connection to the underframe of the rail vehicle no longer safely withstands the effective lifting force.

DE 17 79 864 U1 discloses a rerailing device consisting of a railroad crane with a rotatable crane part and a jib which is fitted with lifting gear. Arranged beneath the jib is a clamp in the form of an L-shaped beam with a downward-pointing end. The lower end thereof is designed to be fork-shaped and serves as a grab which is provided with a timber support. When a derailed rail car is rerailed the clamp is first rotated in the requisite direction with the help of the rotatable part and is then pushed underneath the car with the grab. With the help of the lifting gear the car can then be lifted, wherein because the clamp is mounted in the manner of a universal joint the timber support can be adjusted to the inclined position of the derailed car. Once the car has been lifted a little it can be rerailed with the help of the rotating part.

BRIEF SUMMARY OF THE INVENTION

The object of the invention is hence to provide a lifting system for rerailing a rail vehicle, in which a lifting device which can be positioned in front of a rail vehicle can be used.

The object is achieved by a lifting system as claimed. A lifting system for rerailing a rail vehicle, in particular a locomotive, accordingly comprises a support profile of an undercarriage structure of the rail vehicle running transversely to the longitudinal axis of the vehicle at a front end of the rail vehicle. It further comprises a gripping element, which can be lifted and lowered by a lifting device, having two hook-shaped gripping brackets, the hooked profile of which corresponds to the support profile. The gripping brackets for lifting and lowering the rail vehicle by gripping under the support profile can thereby be engaged symmetrically to the vehicle longitudinal center plane. The undercarriage structure has a support unit with a front opening forming a coupling cage, through which front opening a central buffer coupling with integrated energy absorption element extends, wherein the support profile forms a top edge of the front opening, and wherein the gripping brackets are spaced apart such that for the engagement of the gripping element they can be positioned under the support profile by being lowered on both sides of the central buffer coupling and by then being inserted into the front opening. By integrating an energy absorption element into the central buffer coupling the coupling shaft has a length or nature which rules out any use of the central buffer coupling as a central lifting point for a lifting device. The support profile which instead serves as a lifting point is part of the support unit, which continues the undercarriage structure of the rail vehicle under the driver's cab thereof. The support unit itself can have a plateau section integrated into the underframe, two side wall sections and a track clearance receiver. The coupling cage formed in this way has a high bending moment because of its structure and hence can transmit the induced lifting forces of the lifting device for lifting the rail vehicle via the support profile which extends between the side wall sections. By this means a frontal, central lifting point is provided on the rail vehicle, which because it is structurally integrated into the undercarriage structure withstands the induced lifting forces of the lifting device. In this way it is possible to avoid positioning the lifting device at a central buffer coupling of the rail vehicle, since the lifting forces that arise from long coupling shafts cannot safely be transmitted to the underframe of the rail vehicle. Instead a gripping element with two gripping brackets is inventively positioned on the support profile designed as a lifting point. The hooked profile of the gripping brackets is thereby adapted to the profile cross-section of the support profile, so that it is possible to safely grip under the rail vehicle at its front end and thus safely lift and lower it. In this case the support profile is supported on two support points which are formed by the gripping brackets and are arranged symmetrically to the vehicle longitudinal center plane.

In an advantageous embodiment of the inventive lifting system the gripping element has a horizontally lying joint pin, to which the gripping brackets are rotatably connected. Thanks to the joint pin relative movements between the lifting device supporting the gripping element and the rail vehicle can be equalized during rerailing.

Advantageously the gripping element of the inventive lifting system has two lifting belts, which are each rotatably connected at one end to the joint pin and at the other end can be connected to the lifting device. The lifting belts represent an interface between the joint pin on the one hand and on the other hand for example a crane hook of a hoisting crane designed as a lifting device. Alternatively the interface can also be formed by chains. When using a lifting device designed as a crane the crane hook can also hook directly into the gripping element, in other words without a further interface.

In a preferred embodiment the inventive lifting system comprises an actuatable safety device, by means of which the gripping element made to engage with the support profile can be secured against disengagement in the absence of the lifting force of the lifting device. So long as the engaged gripping element transmits a lifting force a firm fit exists between gripping element and support profile. So that the relative position between gripping element and support profile is not unintentionally lost in the absence of lifting force, a safety device can be actuated which prevents disengagement. In this way damage to the rail vehicle caused by the unsecured gripping element falling or swinging in an uncontrolled manner can be prevented.

Advantageously the safety device of the inventive lifting system has a safety element fixed to the rail vehicle and a through-hole penetrating the gripping bracket for receiving the safety element, wherein the safety device can be actuated by producing a form-fit connection between safety element and gripping bracket. The safety element can be designed as a carabiner or as a pin with splint and its freedom of movement can be restricted by a chain fixed to the rail vehicle. The safety element can however also be attached to the rail vehicle by means of a cable, screws, a lever, or similar. In this way just one gripping bracket or else both gripping brackets can be secured by form fit.

In an advantageous embodiment of the inventive lifting system the support profile is designed as a ride-up protection means to prevent the rail vehicle riding up during a collision with another rail vehicle. The support profile can jut out from the end-face surface of the front of the vehicle and if appropriate can be provided with transverse ribs, which become caught in a corresponding ride-up protection means of a colliding rail vehicle and in so doing counteract the riding up and derailing of one of the rail vehicles. Alternatively the support profile can be any part of the vehicle structure which withstands the forces induced during lifting; in addition to the ride-up protection means this can also be a coupling carrier, a head transverse support, a buffer plate or similar.

In a further advantageous embodiment of the inventive lifting system the lifting device is designed as a crane truck with support cable, wherein the support cable can be connected to the gripping element, for example to the lifting belts thereof. In this embodiment the lifting device is quickly available at the place of deployment of a rail vehicle with a derailed undercarriage and there also at once assumes the requisite position on the track in front of the front end of the rail vehicle. This is particularly advantageous when a place of deployment is located in a tunnel, at which little or no space is available for a lifting device beside the track.

Other features and advantages of the inventive lifting system emerge from the following description of the drawings.

DESCRIPTION OF THE INVENTION

Figure 1:
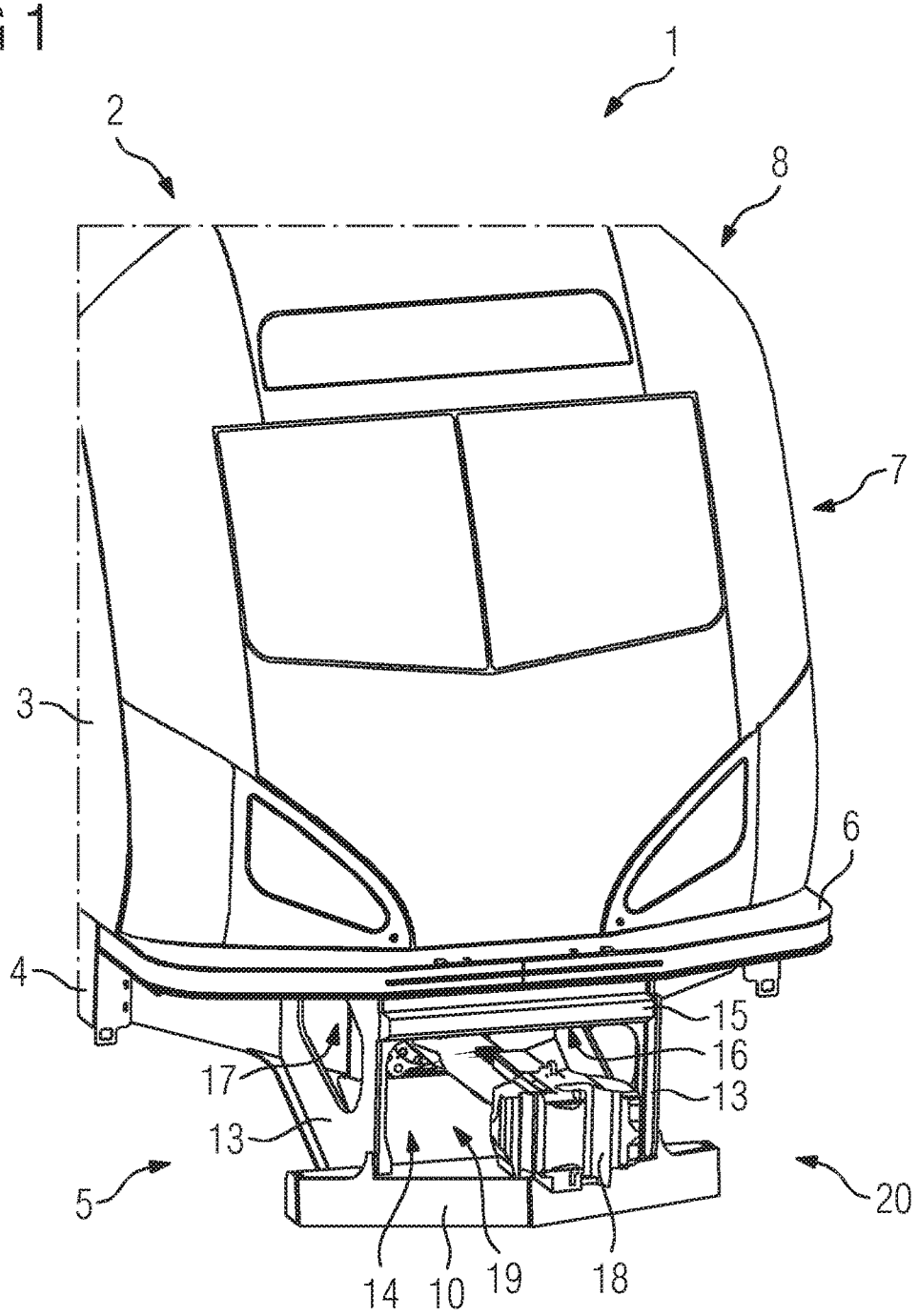
FIG. 1 a perspective depiction of a front end of a rail vehicle with support profile as a lifting point, FIG. 2 an enlarged section from FIG. 1 with an engaged gripping element and FIG. 3 a side view of a central buffer coupling and an engaged gripping bracket of the gripping element.

According to FIG. 1 a rail vehicle designed as a locomotive 1 has a vehicle structure 2 which is supported on undercarriages (not illustrated) with wheel sets which run on rails of a track (likewise not shown). The vehicle structure 2 comprises a vehicle body 3 which is supported by an undercarriage structure. The undercarriage structure has longitudinal supports 4 extending in the vehicle longitudinal axis and transverse supports running at right angles thereto. Arranged at a front end 8 of the locomotive 1 is a support unit 5 which forms a plateau section 6 which has a horizontal laminar extension and is permanently integrated into the undercarriage structure and thus into the vehicle structure 2 of the locomotive 1. In other words the plateau section 6 is permanently connected to longitudinal supports 4 and transverse supports of the undercarriage structure. Thus the support unit 5 and in particular the plateau section 6 is for example welded to the longitudinal supports 4 and the driver's cab 7 extending above the plateau section 6 or is permanently connected in another manner. The support unit 5 not only has the plateau section 6 but also a track clearance receiver 10, which is provided for holding and attaching rake blades of a track clearance unit. The track clearance receiver 10 is permanently connected to the plateau section 6 via side wall sections 13. The side wall sections 13 extend between the track clearance receiver 10 and the plateau section 6, thereby forming a coupling cage 14 which is bounded at the bottom by the track clearance receiver 10 and laterally by the side wall sections 13. The coupling cage 14 can be bounded at the top for example by the plateau section 6. In addition a support profile 15 extends transversely to the vehicle longitudinal axis between the side wall sections 13 and is permanently welded to the side wall sections 13 and is designed to be particularly stable. In a collision the support profile 15 engages with the support profile of an oncoming rail vehicle, preventing the locomotive 1 or the rail vehicle from riding up and thereby preventing derailing. The coupling cage 14 delimits the movement of a central buffer coupling 18 according to FIG. 2, which extends out from a feed-through opening 17 formed further back in the undercarriage section through the coupling cage 14 in the direction of travel forward from a front opening 19 of the coupling cage 14. The central buffer coupling 18 serves to couple further rail vehicles and because of an integrated energy absorption element has a comparatively long coupling shaft.

Figure 2:
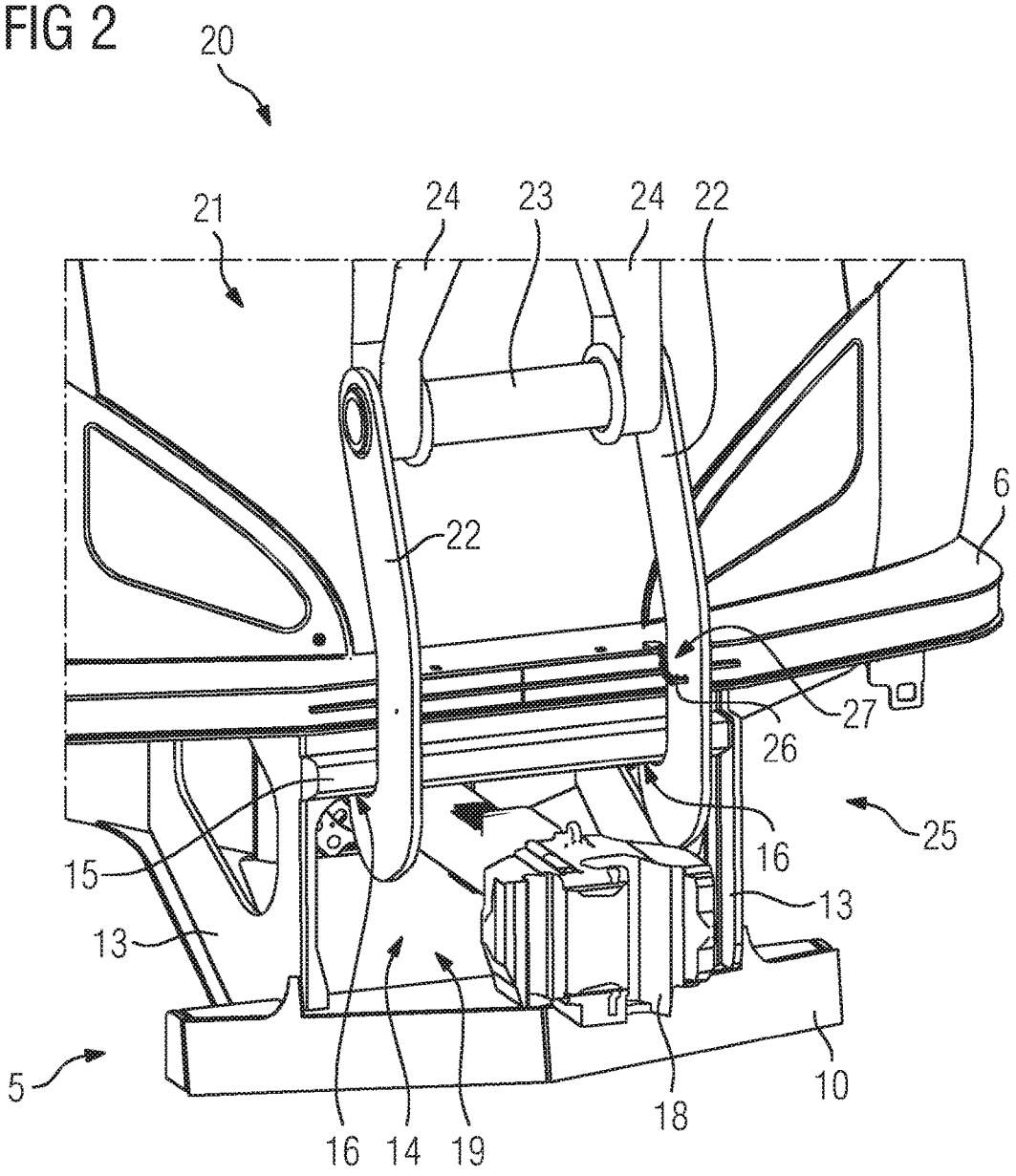
Figure 3:
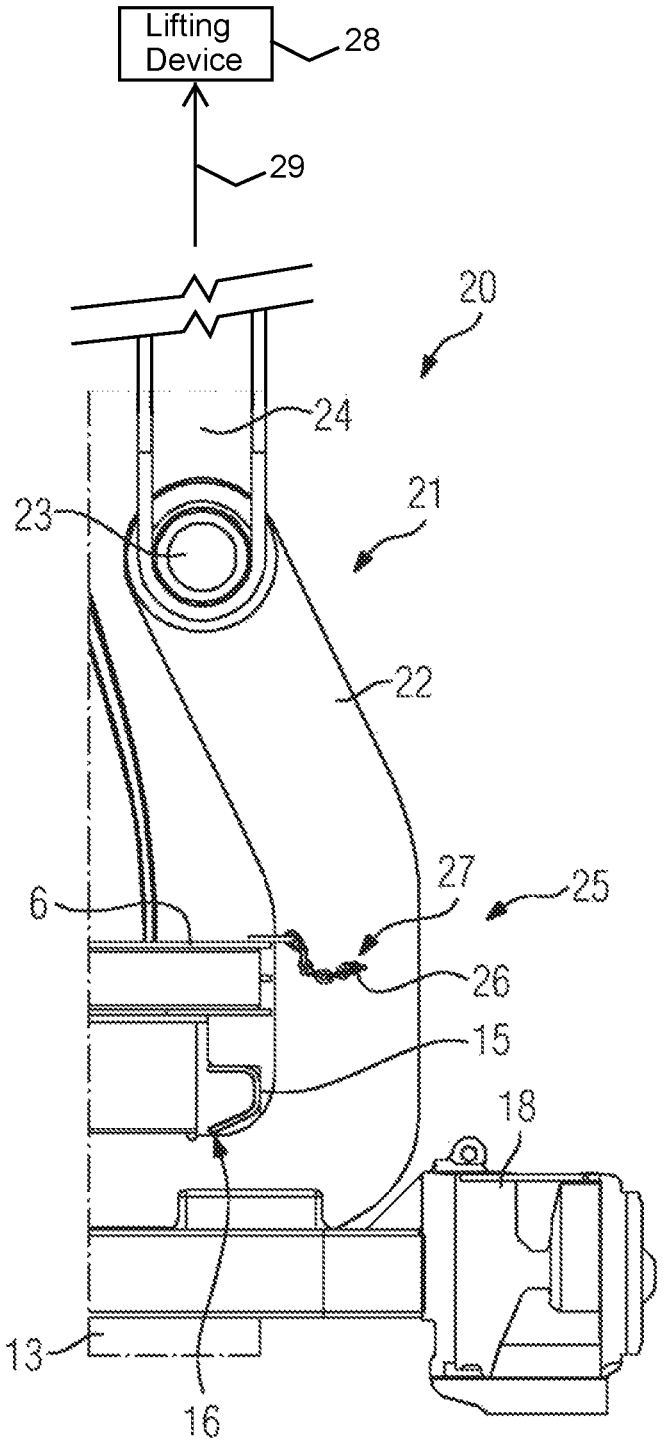

An inventive lifting system 20 for rerailing a rail vehicle, in particular the locomotive 1, now comprises according to FIG. 2 and FIG. 3 the support profile 15 at the front end 8 of the locomotive 1 as a central lifting point 16 for a lifting device. Because of the cage-like structure of the support unit 5 this has a high bending moment, so that high lifting forces can be absorbed, without the support unit 5 having to manufactured from particularly thick material. The lifting system 20 further comprises a gripping element 21 with two hook-shaped gripping brackets 22 which can be raised and lowered by the lifting device. The hooked profile of the gripping brackets 22 corresponds to the cross-section profile of the support profile 15. The gripping brackets 22 can be engaged for lifting and lowering the rail vehicle by gripping under the support profile 15 symmetrically to the vehicle longitudinal central plane. The gripping element 21 has a horizontally lying joint pin 23, to which the gripping brackets 22 are rotatably connected. The gripping element 21 further has two lifting belts 24 which can each be rotatably connected at one end to the joint pin 23 and at the other end to the lifting device.

The lifting system 20 additionally comprises an actuatable safety device 25, by means of which the gripping element 21 engaged with the support profile can be secured against disengagement in the absence of lifting force of the lifting device. The safety device 25 has a safety element chained to the rail vehicle, which in the depicted exemplary embodiment is designed as a pin 26, and a through-hole 27 penetrating the gripping bracket 22 to receive the safety element. In this case the securing means 25 can be actuated by producing a form-fit connection between safety element 26 and gripping bracket 22. The gripping brackets 22 are spaced apart such that to engage the gripping element 21 they can be positioned under the support profile 15 by being lowered on both sides of the central buffer coupling 18 and by then being inserted into the front opening 19. As diagrammatically shown in FIG. 3, the lifting device 28 can be designed as a crane truck 28 with support cable 29, wherein the support cable 29 can be connected to the lifting belts 24 of the gripping element 21. In this way the locomotive 1 can be lifted and thus rerailed.

The invention claimed is:

1. A lifting system comprising:

a rail vehicle with an undercarriage structure, said undercarriage structure having a support unit, said support unit having a plateau section permanently affixed to said undercarriage structure and a track clearance receiver connected to said plateau section by side wall sections;

a coupling cage being defined by said plateau section bounding a top of said cage, said side walls bounding lateral sides of said cage and said track clearance receiver bounding a bottom of said cage, and said plateau, said side walls and said track clearance receiver delimiting a front opening of said coupling cage;

a support profile affixed at opposite ends thereof to said side walls, said support profile running transversely to a longitudinal axis of said rail vehicle and across said front opening;

a central buffer coupling with integrated energy absorption element projecting through said front opening;

a gripping element to be raised and lowered by a lifting device, said gripping element having two hook-shaped gripping brackets said gripping brackets being spaced apart from one another and configured to be positioned under said support profile symmetrically to a vehicle longitudinal center plane for engagement of said gripping element by being lowered on both sides of said central buffer coupling and by subsequently being inserted into said front opening for engagement of said gripping element with said undercarriage structure for lifting and lowering the rail vehicle; and said gripping brackets having a hooked profile corresponding to said support profile.

2. The lifting system according to claim 1, wherein the rail vehicle is a locomotive and the gripping element is dimensioned for lifting the locomotive.

3. The lifting system according to claim 1, further comprising an actuatable safety device including a pin for securing said gripping element that is engaged with said support profile against disengagement in an absence of a lifting force of said lifting device.

4. The lifting system according to claim 3, wherein said pin is attached to said rail vehicle and a through-hole penetrates said gripping bracket to receive said safety pin, said safety pin is actuated by producing a form-fit connection between said safety pin and said gripping bracket.

5. The lifting system according to claim 1, wherein said support profile is formed as a ride-up protection device configured to prevent said rail vehicle riding up in an event of a collision with another rail vehicle.

6. The lifting system according to claim 1, wherein said lifting device is a crane truck with a support cable to be connected to said gripping element.

7. A lifting system comprising:

a rail vehicle with an undercarriage structure, said undercarriage structure having a support unit with a front opening disposed at a front end of said rail vehicle, said support unit with said front opening forming a coupling cage and having a support profile running transversely to a longitudinal axis of said rail vehicle and forming a top edge of said front opening;

a central buffer coupling with integrated energy absorption element projecting through said front opening;

a gripping element to be raised and lowered by a lifting device, said gripping element having two hook-shaped gripping brackets said gripping brackets being spaced apart from one another and configured to be positioned under said support profile symmetrically to a vehicle longitudinal center plane for engagement of said gripping element by being lowered on both sides of said central buffer coupling and by subsequently being inserted into said front opening for engagement of said gripping element with said undercarriage structure for lifting and lowering the rail vehicle, said gripping element including a horizontal joint pin, and said gripping brackets being rotatably connected to said joint pin; and said gripping brackets having a hooked profile corresponding to said support profile.

8. The lifting system according to claim 7, wherein said gripping element comprises two lifting belts each having an end rotatably connected to said joint pin and an end connected to said lifting device.

* * * * *